US005909746A

United States Patent [19]

Doster et al.

[11] Patent Number: 5,909,746

[45] Date of Patent: Jun. 8, 1999

[54] REVERSIBLE UMBRELLA

[76] Inventors: Thomas R. Doster; Karel J. Doster, both of P.O. Box 2136, Matthews, N.C. 28106

[21] Appl. No.: 08/967,922

[22] Filed: Nov. 12, 1997

[51] Int. Cl.[6] ..... A45B 19/00

[52] U.S. Cl. ..... 135/25.1; 135/29; 135/31

[58] Field of Search ..... 135/25.1, 25.3, 135/25.31, 25.33, 29, 25.34, 31, 32, 25.32

[56] References Cited

U.S. PATENT DOCUMENTS

| | | |
|---|---|---|
| 973,207 | 10/1910 | Pokorny . |
| 973,406 | 10/1910 | Clark . |
| 1,264,010 | 4/1918 | Calusinski . |
| 2,711,182 | 6/1955 | Kiel et al. . |
| 4,682,617 | 7/1987 | Schultes et al. . |
| 4,739,783 | 4/1988 | Yang . |
| 4,766,917 | 8/1988 | Yang . |
| 5,085,239 | 2/1992 | Chin-Hung et al. . |
| 5,564,449 | 10/1996 | Lin et al. . |
| 5,615,697 | 4/1997 | Lin et al. . |
| 5,617,889 | 4/1997 | Wu . |

*Primary Examiner*—Lanna Mai
*Attorney, Agent, or Firm*—Clifton Ted Hunt

[57] ABSTRACT

In this invention an umbrella with a cover, preferably square or rectangular, is supported on a telescopic shaft by articulated ribs that extend from the shaft beneath the cover. The articulated ribs are connected to auxiliary ribs and both are controlled by guides and stabilizers that extend radially from a reciprocable transfer sleeve on the telescopic shaft and move the ribs and auxiliary ribs to fold the cover inside out as the transfer sleeve is lowered on the shaft, the shaft is shortened, and the umbrella is closed.

8 Claims, 4 Drawing Sheets

REVERSIBLE UMBRELLA

FIELD OF THE INVENTION

This invention relates to a reversible umbrella with a cover that folds in half when the umbrella is closed from its erected position, and more specifically to a reversible umbrella with a square or rectangular cover having a peripheral edge that is elevated to turn the cover inside out as the cover is folded while closing the umbrella.

BACKGROUND OF THE INVENTION

The following patents show the state of the art for reversible umbrellas as known to applicants:

U.S. Pat. No. 428,661 issued May 27, 1890 to Albin for UMBRELLA OR PARASOL FRAME;

U.S. Pat. No. 2,607,362 issued Aug. 19, 1952 to Evans for REVERSIBLE UMBRELLA;

U.S. Pat. No. 2,725,066 issued Nov. 29, 1955 to Estes et al. for REVERSIBLE UMBRELLA;

U.S. Pat. No. 2,788,792 issued Apr. 16, 1957 to Koller for WIND-RESISTANT REVERSIBLE UMBRELLA; and U.S. Pat. No. 5,284,172 issued Feb. 8, 1994 to Teate, Jr. for REVERSING UMBRELLA APPARATUS.

Albin, Evans and Koller show reversible umbrellas supported on shafts of constant lengths.

Estes discloses several embodiments. The embodiment of FIGS. 1–3 has a circular cover supported beneath ribs on a constant-length shaft.

The embodiment of FIGS. 4–7 has a circular flexible cover supported on braces connected to telescopic ribs on a constant-length shaft. The braces are also connected to a reciprocable hand-hold that is manipulated on the shaft to open the umbrella and close it with the cover turned inside out.

The embodiment of FIG. 8 in Estes has a square cover on a constant-length shaft. The square cover is turned inside out by ribs and braces externally of the cover as the umbrella is closed.

Estes' embodiment of FIGS. 9–14 has a circular cover supported on telescopic ribs extending radially from a reciprocable hand-hold on a telescopic shaft and on braces extending radially from a cap on top of the telescopic shaft. The cover is turned inside out as the umbrella is closed. The telescopic ribs undesirably increase the weight of the umbrella.

Teate discloses an umbrella with a tubular shaft including a collar with ribs mounted to the collar and each rib including a slide housing and a support rib. A cover is secured to the ribs. The slide is arranged in cooperation with the slide housings to reverse the arcuate orientation of the ribs and turn the ribs from a downward to an upward position.

An umbrella with a square cover has the advantage of stability, as noted by Estes, and also has the advantage of providing more protection in confined areas, as in getting in and out of a car. The advantages of umbrellas with telescopic shafts that shorten when the umbrella is closed are well known but most such umbrellas do not turn the cover inside out as the umbrella is closed.

SUMMARY OF THE INVENTION

It is an object of this invention to provide an umbrella with a cover, preferably square or rectangular, supported on a telescopic shaft by articulated ribs that extend from the shaft beneath the cover and are controlled by guides and stabilizers extending radially from a reciprocable transfer sleeve on the telescopic shaft to fold the cover inside out as the shaft is shortened and the umbrella is closed.

DETAILED DESCRIPTION OF A PREFERRED EMBODIMENT OF THE INVENTION

Figure 1:
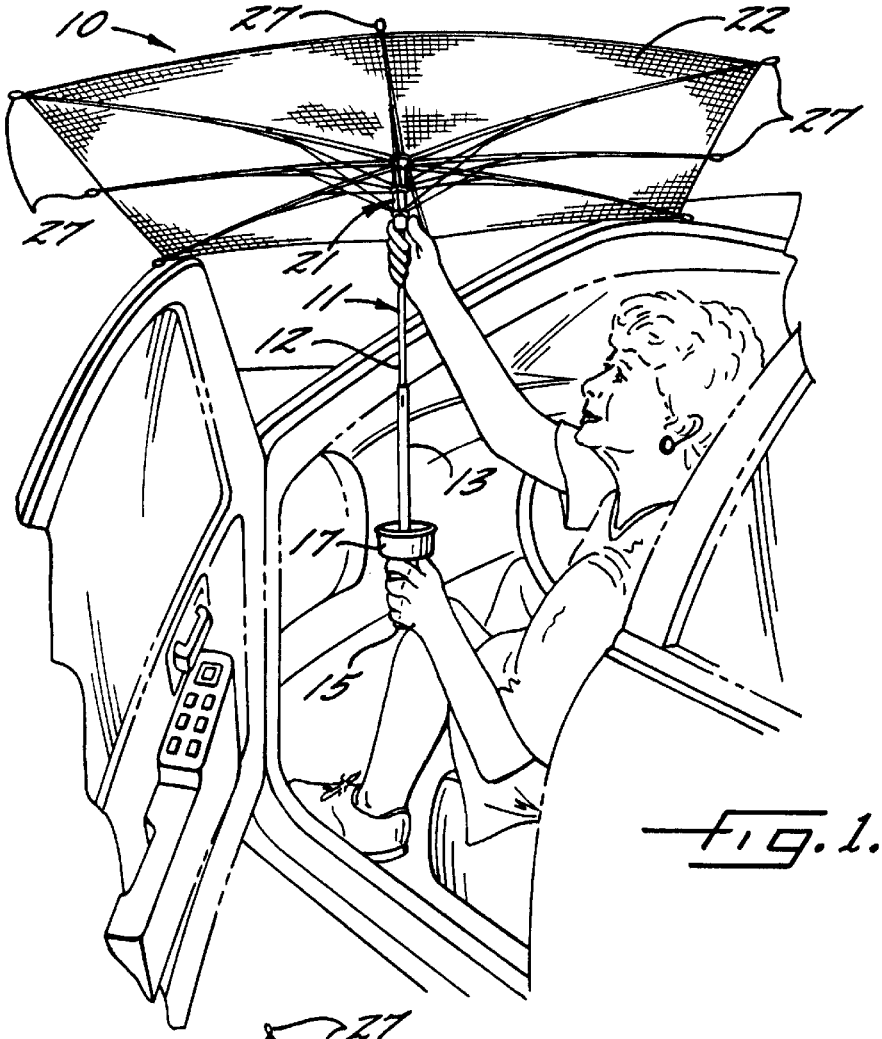
FIGS. 1 and 2 are environmental perspective views illustrating an advantage of an umbrella with a square or rectangular cover supported on a telescopic shaft.
Figure 2:
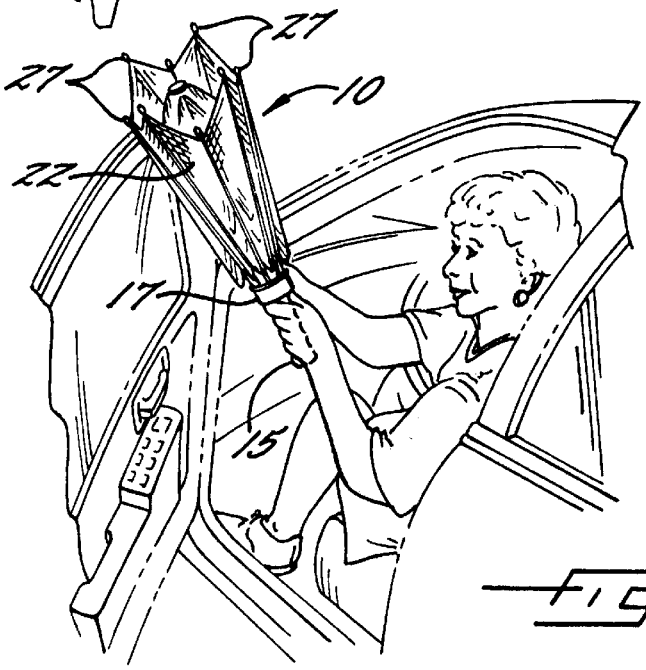

In the illustrated embodiment of the invention, the umbrella, broadly indicated at 10, comprises a telescopic shaft broadly indicated at 11. The shaft 11 includes a channel-shaped upper portion 12 and a tubular lower portion 13 mounted for reciprocal movement on the channel-shaped upper portion 12. A spring-pressed stop 14 extends through a slot in the tubular lower portion 13 of the shaft 11 to lock the shaft 11 in fully extended position when the umbrella is open, as in FIGS. 1 and 3.

The lower portion 13 of the shaft 11 terminates inside a handle 15 that is fastened as by a screw 16 to the lower portion 13. A cup 17 is seated on top of the handle 15 and the bottom wall 17A of the cup is penetrated by the shaft's lower portion 13.

A tubular connector 20 is mounted on top of the shaft 11 and fixed against rotation relative to the shaft 11 by a rib (not shown) that extends into the channel 12A of the channel-shaped upper portion 12.

An anchor ring 23 (FIG. 7) extends around the tubular connector 20 and is seated in an annular groove (not shown). A plurality of ribs 24 extend radially from the tubular connector and are fastened at their inner ends to the anchor ring 23. The outer end of each rib 24 is hinged as at 25 to a spanner 26 that is fixed at one end to an auxiliary rib 24A that extends radially in FIG. 3 to the outer edge of a cover 22. The cover 22 is suitably fixed to the outer ends of the auxiliary ribs 24A in a known manner. The outer ends of the auxiliary ribs 24A are preferably covered with plastic tips 27 to prevent undesirable scratching of surfaces contacted by those portions of the umbrella.

An operating sleeve 21 is slidably mounted on the shaft 11 for movement to the top of upper portion 12 to open the umbrella and spread its cover 22, and to the bottom of the lower portion 13 to fold the cover 22 and close the umbrella.

Figure 7:
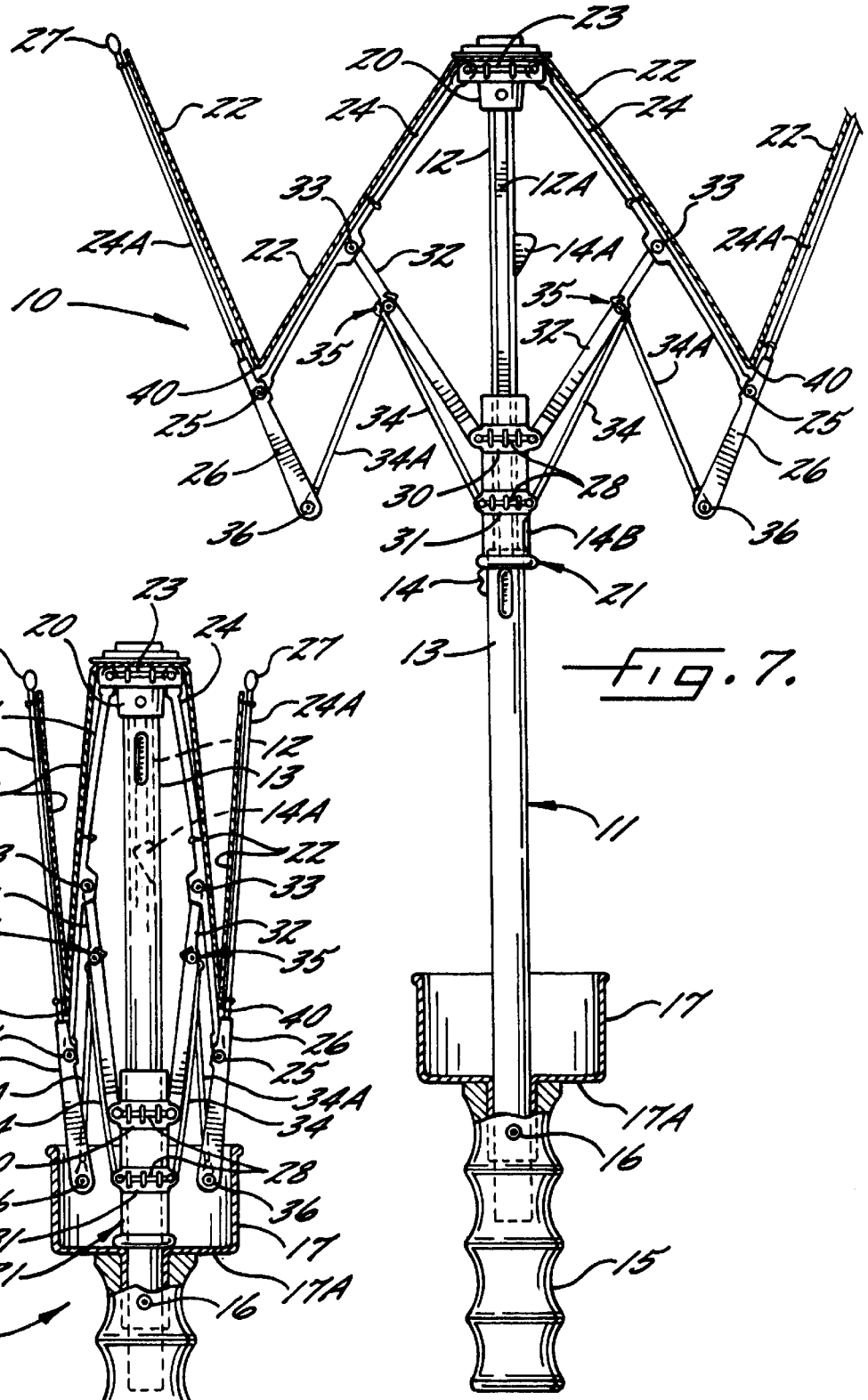
FIG. 7 is a side view, partially in section, of the umbrella at a transitional stage between the open position of FIG. 3 and the closed position of FIG. 8.

A first annular abutment 30 extends around the operating sleeve 21 in spaced relation to the upper end of the sleeve 21 in FIG. 7, and a second annular abutment 31 extends around the operating sleeve 21 in downwardly spaced relation to the first abutment 30 in FIG. 7. Anchor rings 28 extend around the annular abutments 30 and 31.

A plurality of guides 32 are connected at their inner ends to the anchor ring 28 on the annular abutment 30, with the guides 32 extending radially from the annular abutment 30 in vertically spaced relation to the ribs 24 that extend radially from the anchor ring 23 on tubular connector 20, there being a guide 32 beneath each rib 24. The outer end of each guide 32 is hinged as at 33 to the midportion of a rib 24.

Stabilizers 34 are connected at their inner ends to the anchor ring 28 on second annular abutment 31, with the stabilizers 34 extending radially from the second annular abutment 31 in vertically spaced relation to the guides 32 that extend radially from the first annular abutment 30, there being a stabilizer 34 beneath each guide 32. The outer end of each stabilizer 34 is hinged as at 35 to the midportion of a guide 32.

An auxiliary stabilizer 34A is hingedly connected as at 35 to each stabilizer 34 at its juncture with the midportion of a guide 32. The auxiliary stabilizers 34A extend therefrom to hinged connections 36 with the inner ends of the spanners 26.

Figures 3, 4, 5:
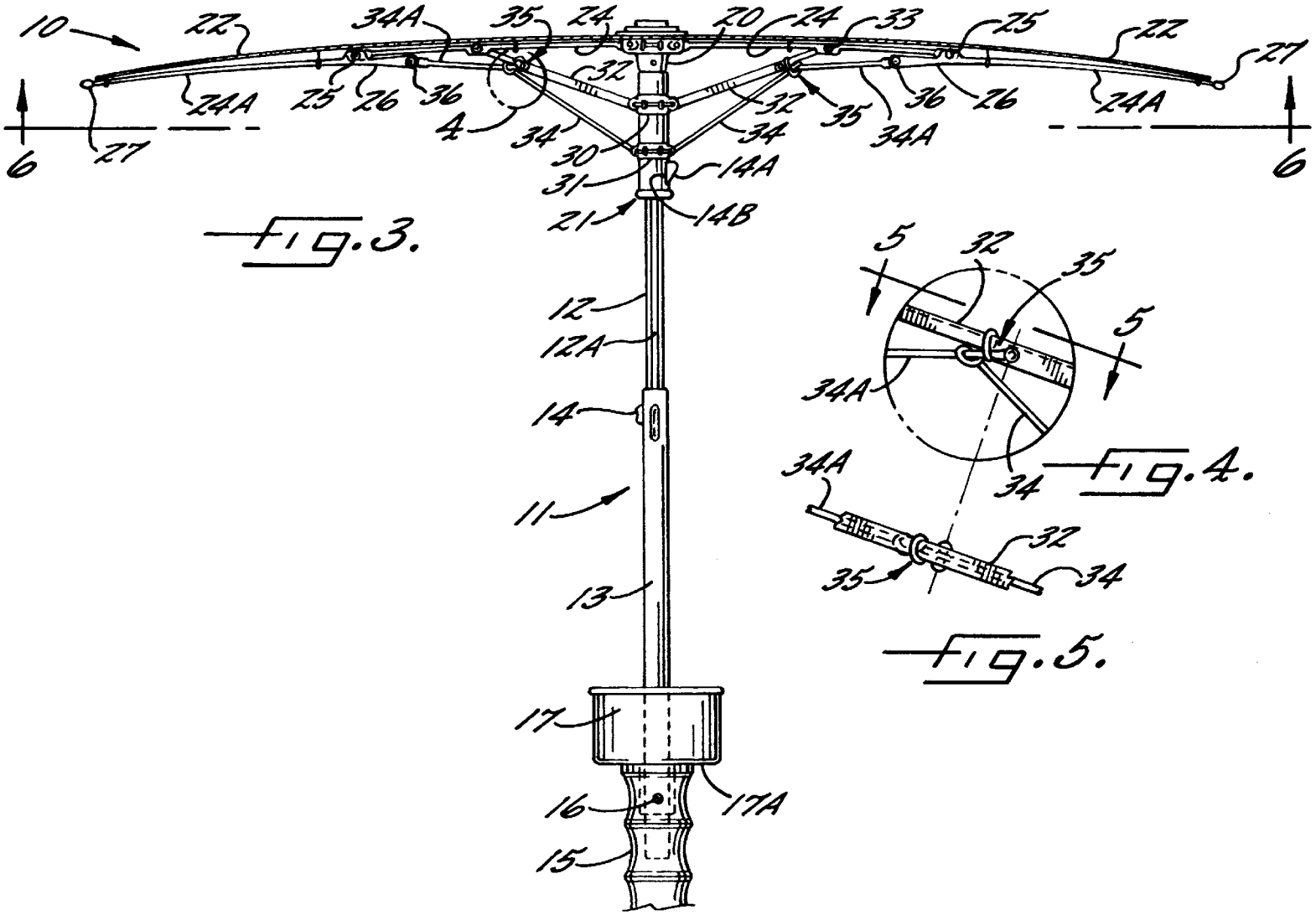
FIG. 3 is a side view of the umbrella in the open position.
FIG. 4 is an exploded view of the circled area indicated at 4 in FIG. 3.
FIG. 5 is a top view taken along the line 5—5 in FIG. 4.
Figure 6:
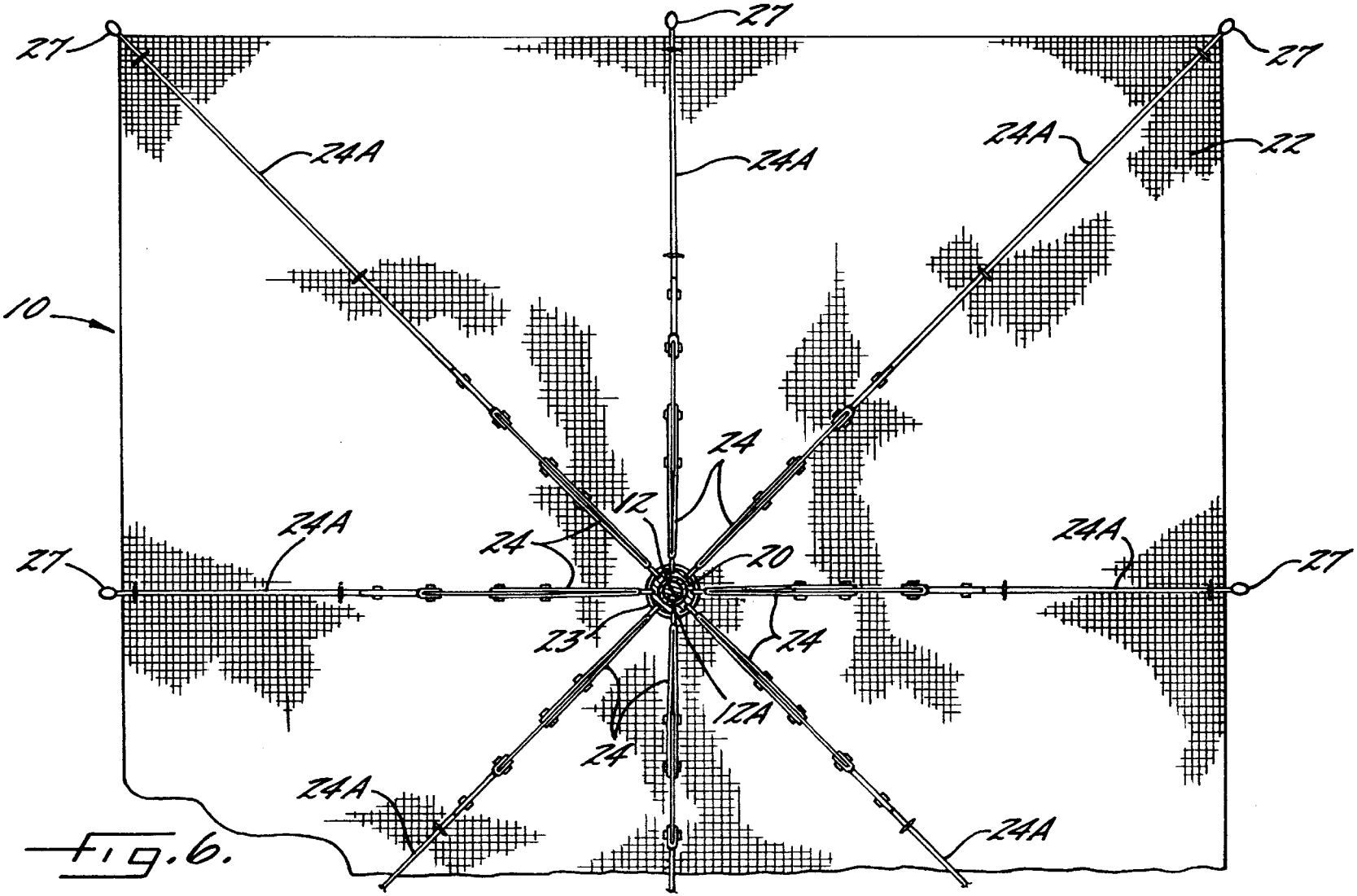
FIG. 6 is an inverted plan view, partially in section, of the open umbrella shown in FIG. 3.

A spring-pressed stop 14A in the channel-shaped upper portion 12 extends through a slot 14B in the operating sleeve 21 to releasably lock the umbrella in the fully open position of FIG. 3.

Opening the Umbrella

Figure 8:
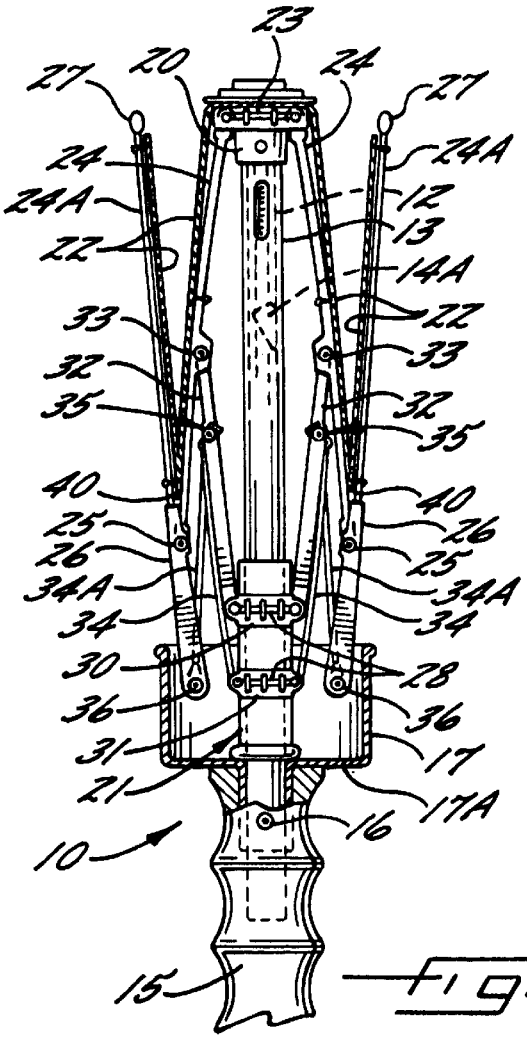
FIG. 8 is a side view, partially in section, of the umbrella in the closed position.

The umbrella 10 is moved from the closed position of FIG. 8 to the open position of FIG. 3 by first grasping with one hand the portion of the transfer sleeve 21 beneath the second annular abutment 31 while grasping with the other hand the handle 15.

The transfer sleeve 21 and handle 15 are then pulled apart, causing the lower portion 13 to slide through the transfer sleeve as the lower portion is pulled along the upper portion 12 of the shaft 11 until the transfer sleeve 21 moves past the spring pressed latch and releases it to lock the shaft 11 in its fully extended position.

Movement of the transfer sleeve 21 from its position in FIG. 8 to its position in FIG. 7 causes outward radial movement of the guides 32 and their stabilizers 34, and corresponding upward movement of the ribs 24 from their positions in FIG. 8 to their positions in FIG. 7.

Continued movement of the transfer sleeve 21 along the shaft 11 toward the tubular connector 20 causes the guides 32 to push the ribs 24 upwardly while elevating the hinged junctures 36 of the auxiliary stabilizers 34A and spanners 26, and unfolding the cover 22.

When the transfer sleeve 21 reaches the tubular connector 20 and is locked in position by the latch 14A (FIG. 3), the auxiliary stabilizers 34A and spanners 26 are in substantial alignment with each other as the ribs 24 and 24A are fully extended and the cover 22 is fully unfolded and in operative position.

Closing the Umbrella

The umbrella 10 is moved from the open position of FIG. 3 to the closed position of FIG. 8 by first grasping with one hand the portion of the transfer sleeve 21 beneath the second annular abutment 31 while grasping with the other hand the handle 15.

The transfer sleeve 21 is then moved toward the handle 15, causing the transfer sleeve to slide downwardly over the upper portion 12 of the shaft 11 and reach the spring-pressed latch 14. When the transfer sleeve reaches the latch 14 and moves over it, the spring-pressed latch 14 is depressed beneath the wall of the tubular lower portion 13 allowing telescopic movement of the upper and lower portions 12 and 13, with shortening of the shaft 11.

Continued movement of the transfer sleeve 21 and handle 15 toward each other from their positions in FIG. 7 causes the tubular lower portion 13 of the shaft 11 to slide over the channel-shaped upper portion 12 and move the ribs 24 and 24A toward each other and fold the cover 22 inside out with the outer edge of the cover extending upwardly, as in FIG. 8.

With the cover folded inside out and the outer edge of the cover extending upwardly as in FIG. 8, water on the outer surface of the cover 22 tends to collect along a fold line 40 that forms in the mid-portion of the cover as the ribs 24 and 24A are moved toward each other when closing the umbrella.

Some water may be squeezed from the cover when the umbrella is in the fully closed position of FIG. 8. Water that is squeezed from the cover drips downwardly along the spanners 26 and collects in the cup 17 on the handle 15.

Conclusion

There is thus provided a reversible umbrella that can be easily moved into and out of operative position. When the umbrella is closed to its inoperative position, the cover is folded inside out with the edge of the cover at the top of the umbrella, resulting in the exposed inner surface of the cover being dry. Any water leaking from the outer surface of the cover is collected in the cup on top of the handle.

The square or rectangular shape of the cover provides more coverage and protection from rain when the umbrella is being used while getting in or out of a car.

Although specific terms have been used in describing the invention, they have been used in a generic and descriptive sense only and not for the purpose of limitation, the scope of the invention being defined in the claims.

We claim:

1. A reversible umbrella comprising:

a shaft with an upper end and a lower end;

a tubular connector on the upper end of the shaft;

a transfer sleeve mounted on the shaft for reciprocatory movement along the shaft;

a plurality of ribs extending radially from and connected to the tubular connector;

a spanner hingedly connected to the end of each rib distal from the tubular connector;

an auxiliary rib extending outwardly from and connected to each spanner;

a flexible cover overlying the ribs and connected to auxiliary ribs;

means connecting the cover to outer ends of the auxiliary ribs;

a plurality of guides extending radially from and connected to the transfer sleeve and opposite ends of each guide being pivotally connected to the transfer sleeve and to the mid portion of one of the ribs;

a plurality of stabilizers extending radially from and connected to the transfer sleeve and opposite ends of each stabilizer being pivotally connected to the transfer sleeve and to the mid portion of one of the guides;

an auxiliary stabilizer pivotally connecting each guide to one of the spanners;

said guides, stabilizers, auxiliary stabilizers and spanners being responsive to movement of the transfer sleeve toward the upper end of the shaft to extend the ribs and auxiliary ribs outwardly and extend the cover to an open position; and said guides, stabilizers, auxiliary stabilizers and spanners being responsive to movement of the transfer sleeve toward the lower end of the shaft to lower the ribs and elevate the auxiliary ribs while folding a portion of the cover inside out.

2. A reversible umbrella according to claim 1 wherein the shaft is telescopic.

3. A reversible umbrella according to claim 1 wherein the cover is rectangular.

4. A reversible umbrella according to claim 1 wherein there is a handle on the lower end of the shaft.

5. A reversible umbrella according to claim 4 wherein there is a cup on top of the handle.

6. A reversible umbrella according to claim 5 wherein the shaft extends through the cup and into the handle.

7. A reversible umbrella comprising:

a telescopic shaft with an upper portion and a lower portion;

a plurality of ribs extending radially from and connected to the shaft;

means for hingedly connecting the ribs to the upper portion of the shaft;

a spanner hingedly connected to the end of each rib distal from the shaft;

an auxiliary rib extending outwardly from and connected to each spanner;

a flexible cover overlying the ribs and connected to auxiliary ribs;

a handle on the lower portion of the shaft;

a transfer sleeve mounted for reciprocatory movement on the shaft;

a guide extending radially from and connected to both the transfer sleeve and to the mid portion of each rib;

a plurality of stabilizers extending radially from the transfer sleeve and opposite ends of each stabilizer being pivotally connected to the transfer sleeve and to the mid portion of one of the guides;

an auxiliary stabilizer pivotally connecting each guide to one of the spanners;

said guides, stabilizers, auxiliary stabilizers and spanners being responsive to movement of the transfer sleeve toward the upper end of the shaft to extend the ribs and auxiliary ribs outwardly and extend the cover to an open position; and said guides, stabilizers, auxiliary stabilizers and spanners being responsive to movement of the transfer sleeve toward the lower end of the shaft to lower the ribs and elevate the auxiliary ribs while folding a portion of the cover inside out.

8. A reversible umbrella according to claim 7 wherein the cover is of rectangular configuration.

* * * * *